US008160259B2

(12) United States Patent
Noguchi et al.

(10) Patent No.: US 8,160,259 B2
(45) Date of Patent: Apr. 17, 2012

(54) AUDIO SIGNAL PROCESSING APPARATUS, AUDIO SIGNAL PROCESSING METHOD, AND PROGRAM

(75) Inventors: Masayoshi Noguchi, Chiba (JP); Gen Ichimura, Tokyo (JP)

(73) Assignee: Sony Corporation, Tokyo (JP)

( * ) Notice: Subject to any disclaimer, the term of this patent is extended or adjusted under 35 U.S.C. 154(b) by 1209 days.

(21) Appl. No.: 11/827,569

(22) Filed: Jul. 12, 2007

(65) Prior Publication Data

US 2008/0019533 A1 Jan. 24, 2008

(30) Foreign Application Priority Data

Jul. 21, 2006 (JP) ..... 2006-198940

(51) Int. Cl.
*H04R 5/00* (2006.01)

(52) U.S. Cl. ..... 381/17; 381/1; 381/18; 381/22; 381/61

(58) Field of Classification Search ..... 381/1, 17–18, 381/22, 61
See application file for complete search history.

(56) References Cited

U.S. PATENT DOCUMENTS

| | | | | |
|---|---|---|---|---|
| 3,783,192 | A | 1/1974 | Takahashi | |
| 3,821,471 | A * | 6/1974 | Bauer | 381/22 |
| 3,825,684 | A | 7/1974 | Ito et al. | |
| 3,836,715 | A | 9/1974 | Ito et al. | |
| 4,747,142 | A | 5/1988 | Tofte | |
| 4,837,824 | A * | 6/1989 | Orban | 381/1 |
| 4,941,177 | A | 7/1990 | Mandell et al. | |
| 5,046,098 | A * | 9/1991 | Mandell et al. | 381/22 |
| 5,197,100 | A | 3/1993 | Shitaki | |
| 5,319,713 | A * | 6/1994 | Waller et al. | 381/22 |
| 5,333,201 | A * | 7/1994 | Waller, Jr. | 381/22 |
| 5,386,082 | A | 1/1995 | Higashi | |
| 5,524,053 | A * | 6/1996 | Iwamatsu | 381/18 |
| 5,537,435 | A | 7/1996 | Carney et al. | |
| 5,555,310 | A | 9/1996 | Minami et al. | |
| 5,636,283 | A | 6/1997 | Hill et al. | |
| 5,644,640 | A * | 7/1997 | Fosgate | 381/18 |
| 5,742,688 | A | 4/1998 | Ogawa et al. | |
| 6,078,669 | A | 6/2000 | Maher | |
| 6,130,949 | A | 10/2000 | Aoki et al. | |
| 6,251,113 | B1 * | 6/2001 | Appelbaum et al. | 606/107 |
| 6,269,166 | B1 | 7/2001 | Matsuo et al. | |
| 6,870,933 | B2 | 3/2005 | Roovers | |
| 6,920,223 | B1 | 7/2005 | Fosgate | |
| 2002/0150262 | A1 * | 10/2002 | Carter | 381/86 |
| 2003/0152236 | A1 | 8/2003 | Morikawa | |

(Continued)

FOREIGN PATENT DOCUMENTS

EP 0593128 A1 4/1994

(Continued)

*Primary Examiner* — Devona Faulk
*Assistant Examiner* — Disler Paul
(74) *Attorney, Agent, or Firm* — Wolf, Greenfield & Sacks, P.C.

(57) ABSTRACT

An audio signal processing apparatus includes a localization direction detector that detects localization directions of two-channel input audio signals, a localization direction distribution calculator that calculates a distribution of the localization directions detected by the localization direction detector, a gain table information recording unit that records gain table information defining weights corresponding to respective localization angles, a gain generator that generates a gain corresponding to an output audio signal on the basis of the distribution calculated by the localization direction distribution calculator and the gain table information recorded in the gain table information recording unit, and a synthesizing unit that synthesizes the two-channel input audio signals using the gain generated by the gain generator.

13 Claims, 7 Drawing Sheets

U.S. PATENT DOCUMENTS

| | | | | |
|---|---|---|---|---|
| 2005/0169482 | A1 | 8/2005 | Reams et al. | |
| 2006/0067541 | A1 | 3/2006 | Yamada et al. | |
| 2006/0136073 | A1* | 6/2006 | Kastigar | 700/1 |
| 2007/0055497 | A1 | 3/2007 | Kimijima et al. | |
| 2007/0098181 | A1 | 5/2007 | Noguchi | |
| 2007/0110258 | A1 | 5/2007 | Kimijima | |
| 2008/0019531 | A1 | 1/2008 | Kimijima | |
| 2008/0130918 | A1 | 6/2008 | Kimijima | |

FOREIGN PATENT DOCUMENTS

| | | | |
|---|---|---|---|
| EP | 0608937 | A1 | 8/1994 |
| GB | 1411408 | A | 10/1975 |
| JP | 61-081214 | U | 4/1986 |
| JP | 02-298200 | A | 12/1990 |
| JP | 03-236691 | A | 10/1991 |
| JP | 04-079599 | A | 3/1992 |
| JP | 04-165800 | A | 6/1992 |
| JP | 04-249484 | A | 9/1992 |
| JP | 04-296200 | A | 10/1992 |
| JP | 05-060096 | U | 8/1993 |
| JP | 08-172698 | A | 7/1996 |
| JP | 08-248070 | A | 9/1996 |
| JP | 08-275300 | A | 10/1996 |
| JP | 09-172418 | A | 6/1997 |
| JP | 09-200900 | A | 7/1997 |
| JP | 09-511880 | A | 11/1997 |
| JP | 10-066198 | A | 3/1998 |
| JP | 10-136494 | A | 5/1998 |
| JP | 11-113097 | A | 4/1999 |
| JP | 2001-007769 | A | 1/2001 |
| JP | 2001-069597 | A | 3/2001 |
| JP | 2002-058100 | A | 2/2002 |
| JP | 2002-078100 | A | 3/2002 |
| JP | 2002-95096 | A | 3/2002 |
| JP | 2003-79000 | A | 3/2003 |
| JP | 2003-516069 | | 5/2003 |
| JP | 2003-274492 | A | 9/2003 |
| JP | 2004-064363 | A | 2/2004 |
| JP | 2004-135023 | A | 4/2004 |
| JP | 2004-333592 | A | 11/2004 |
| JP | 2005-244293 | A | 9/2005 |
| JP | 2006-014220 | A | 1/2006 |
| JP | 2006-080708 | A | 3/2006 |
| JP | 2006-121152 | A | 5/2006 |
| JP | 2007-081926 | A | 3/2007 |
| WO | WO 99/31938 | A1 | 6/1999 |

* cited by examiner

Lt
Rt
L
R
LS
RS
Lt - Rt
×0.5
×G1
×G2
×G3
×G4
×G5
BAND LIMITING FILTER
BAND LIMITING FILTER
LOCALIZATION DIRECTION DETECTOR
θ
LOCALIZATION DIRECTION DISTRIBUTION MEASURING UNIT
P(θ)
GAIN TABLE MEMORY
K1(θ)
K5(θ)
GAIN GENERATOR
G1
G2
G3
G4
G5
20

AUDIO SIGNAL PROCESSING APPARATUS, AUDIO SIGNAL PROCESSING METHOD, AND PROGRAM

CROSS REFERENCES TO RELATED APPLICATIONS

The present invention contains subject matter related to Japanese Patent Application JP 2006-198940 filed in the Japanese Patent Office on Jul. 21, 2006, the entire contents of which are incorporated herein by reference.

BACKGROUND OF THE INVENTION

1. Field of the Invention

The present invention relates to an audio signal processing apparatus, an audio signal processing method, and a program for deriving output audio signals with desired directivity from two-channel input audio signals.

2. Description of the Related Art

A passive matrix method is widely used to separate a center sound to be localized at the center in front of the listener and a so-called surround sound from two-channel input audio signals, such as a left channel input audio signal L and a right channel input audio signal R. The passive matrix method involves generating a sum L+R and difference L−R of the left and right channel input audio signals in a simple manner. The sum L+R is separated as a center sound and the difference L−R is separated as a surround sound.

As a method for improving the degree of separation of separated signals, PCT Japanese Translation Patent Publication No. 2003-516069 discloses an active matrix method for suppressing crosstalk components included in separated signals, and particularly refers to a technique for adaptively control crosstalk by applying feedback control.

SUMMARY OF THE INVENTION

However, in the active matrix method disclosed in PCT Japanese Translation Patent Publication No. 2003-516069, crosstalk needs to be adaptively controlled according to the directivity of two-channel input audio signals by applying feedback control. Also, there are problems in that the control technique used is complex, and that the directivity is excessively enhanced to improve the degree of separation.

The present invention addresses the above-identified problems by providing an apparatus and method for generating output audio signals having natural directivity in response to two-channel input audio signals.

According to a first embodiment of the present invention, an audio signal processing apparatus for generating at least three-channel output audio signals from two-channel input audio signals includes a plurality of synthesizing units that correspond to the respective output audio signals and to each of which the two-channel input audio signals are supplied or to each of which the two-channel input audio signals and a synthesized audio signal generated from the two-channel input audio signals are supplied; a plurality of gain adjusting amplifiers provided for predetermined audio signals among the audio signals supplied to the synthesizing units, the predetermined audio signals being appropriate for the output audio signals; a plurality of gain tables that correspond to the plurality of gain adjusting amplifiers and define gains for all localization directions according to the corresponding output audio signals; a localization direction detector that detects a localization direction of the two-channel input audio signals at each of time points spaced at predetermined time intervals according to levels of the respective two-channel input audio signals; a localization direction distribution calculator that accumulates information about the localization directions detected by the localization direction detector to calculate a distribution value indicating a distribution of the localization directions with respect to all directions during a predetermined time period including each of the time points spaced at predetermined time intervals; and a gain generator that generates each of gains for their corresponding gain adjusting amplifiers by calculating, for each of the plurality of gain tables, the sum of products, each product being obtained by multiplying the distribution value calculated by the localization direction distribution calculator with each gain value in the gain table. A plurality of gains generated by the gain generator are supplied to their corresponding gain adjusting amplifiers.

In the first embodiment of the present invention, to generate at least three-channel output audio signals from two-channel input audio signals, synthesizing units corresponding to respective channels of the output audio signals are provided. At the same time, the two-channel input audio signals, or the two-channel input audio signals and a synthesized audio signal generated from the two-channel input audio signals are supplied to each of the synthesizing units.

In this case, for some of the audio signals to be supplied to each synthesizing unit, gain adjusting amplifiers appropriate for an output audio signal to be obtained from the synthesizing unit (or appropriate for a channel direction of the output audio signal) are provided. Then, the audio signals are supplied through the appropriate gain adjusting amplifiers to the synthesizing unit. Moreover, a gain table which defines gains for all localization directions according to the corresponding output audio signal is prepared for each gain adjusting amplifier.

Next, the localization direction detector detects the directivity of the two-channel input audio signals. Additionally, the localization direction distribution calculator calculates a distribution value indicating a distribution of the localization directions with respect to all directions during a predetermined time period including a detection time at which information about a localization direction of the input audio signals is detected.

Then, for each of the plurality of gain tables, the sum of products, each product being obtained by multiplying the distribution value calculated by the localization direction distribution calculator with each gain value in the gain table, is calculated. Then, a gain for the corresponding gain adjusting amplifier is controlled with the calculated sum.

In the first embodiment of the present invention, a gain for each gain adjusting amplifier is not determined according to a localization direction detected by the localization direction detector at each of detection times spaced at predetermined intervals. Instead, the localization direction distribution calculator calculates a distribution of localization directions during a predetermined time period including the detection time. Then, a gain for the gain adjusting amplifier is determined according to the calculated distribution.

If a gain for each gain adjusting amplifier is determined according to a localization direction detected by the localization direction detector at each of detection times spaced at predetermined intervals, the gain is dependent on a localization direction detected at a single moment. This means that a sound direction is limited to one direction and thus, the strength of the directivity is not reflected. On the other hand, if a gain for each gain adjusting amplifier is determined according to the distribution of localization directions during a predetermined time period including the detection time, the gain is smoothly controlled according to the strength of directivity of the two-channel input audio signals at each direction, the directivity varying with time.

Thus, in response to the two-channel input audio signals that vary in localization direction with time, output audio signals with natural directivity characteristics can be obtained from the synthesizing units.

According to a second embodiment of the present invention, an audio signal processing apparatus for generating at least one-channel output audio signal from two-channel input audio signals includes a synthesizing unit that corresponds to the output audio signal and to which the two-channel input audio signals and/or a synthesized audio signal generated from the two-channel input audio signals are/is supplied; one or a plurality of gain adjusting amplifiers provided for, of the input audio signals supplied to the synthesizing unit, a predetermined input audio signal corresponding to the output audio signal; one or a plurality of gain tables that correspond to the one or plurality of gain adjusting amplifiers and define gains for all localization directions according to the output audio signal; a localization direction detector that detects a localization direction of the two-channel input audio signals at each of time points spaced at predetermined time intervals according to the levels of the respective two-channel input audio signals; a localization direction distribution calculator that accumulates information about the localization directions detected by the localization direction detector to calculate a distribution value indicating a distribution of the localization directions with respect to all directions during a predetermined time period including each of the time points spaced at predetermined time intervals; and a gain generator that generates each gain for the corresponding one or plurality of gain adjusting amplifiers by calculating, for each of the one or plurality of gain tables, the sum of products, each product being obtained by multiplying the distribution value calculated by the localization direction distribution calculator with each gain value in the gain table. One or a plurality of gains generated by the gain generator is supplied to the corresponding one or plurality of gain adjusting amplifiers.

Control performed for each gain adjusting amplifier corresponding to an audio signal to be input to a synthesizing unit appropriate for an output audio signal in the second embodiment is the same as the control performed in the case of the first embodiment described above.

However, in the second embodiment, at least one-channel synthesized signal that is generated by synthesizing two-channel input audio signals and has directivity different from that of the localization direction of the two-channel input audio signals is derived as an output audio signal. The second embodiment has effects similar to those of the first embodiment described above.

According to a third embodiment of the present invention, an audio signal processing apparatus includes a first synthesizing unit to which one of two-channel input audio signals is supplied and to which the other of the two-channel input audio signals and/or a synthesized audio signal generated from the two-channel input audio signals are/is supplied, and that generates and outputs a first output audio signal; one or a plurality of first gain adjusting amplifiers provided for, among the audio signals supplied to the first synthesizing unit, a predetermined audio signal corresponding to the first output audio signal; a second synthesizing unit to which the other of the two-channel input audio signals is supplied and to which the one of the two-channel input audio signals and/or a synthesized audio signal generated from the two-channel input audio signals are/is supplied, and that generates and outputs a second output audio signal; one or a plurality of second gain adjusting amplifiers provided for, among the audio signals supplied to the second synthesizing unit, a predetermined audio signal corresponding to the second output audio signal; a plurality of gain tables that correspond to the first and second gain adjusting amplifiers and define gains for all localization directions according to output audio signals to be obtained from the first synthesizing unit and second synthesizing unit; a localization direction detector that detects a localization direction of the two-channel input audio signals at each of time points spaced at predetermined time intervals according to the levels of the respective two-channel input audio signals; a localization direction distribution calculator that accumulates information about the localization directions detected by the localization direction detector to calculate a distribution value indicating a distribution of the localization directions with respect to all directions during a predetermined time period including each of the time points spaced at predetermined time intervals; and a gain generator that generates each of gains for their corresponding gain adjusting amplifiers by calculating, for each of the plurality of gain tables, the sum of products, each product being obtained by multiplying the distribution value calculated by the localization direction distribution calculator with each gain value in the gain table. A plurality of gains generated by the gain generator are supplied to their corresponding gain adjusting amplifiers.

Control performed for gain adjusting amplifiers corresponding to audio signals to be input to synthesizing units appropriate for respective output audio signals in the third embodiment is the same as the control performed in the case of the first embodiment.

However, in the third embodiment, two-channel output audio signals with enhanced directivity characteristics and the same channel directions as those of respective two-channel input audio signals are obtained. The third embodiment also has effects similar to those of the first embodiment described above.

Thus, with the above-described embodiments of the present invention, in response to two-channel input audio signals that vary in localization direction with time, output audio signals with natural directivity characteristics can be obtained.

DESCRIPTION OF THE PREFERRED EMBODIMENTS

An audio signal processing apparatus and method according to embodiments of the present invention will now be described with reference to the drawings.

Figure 1:
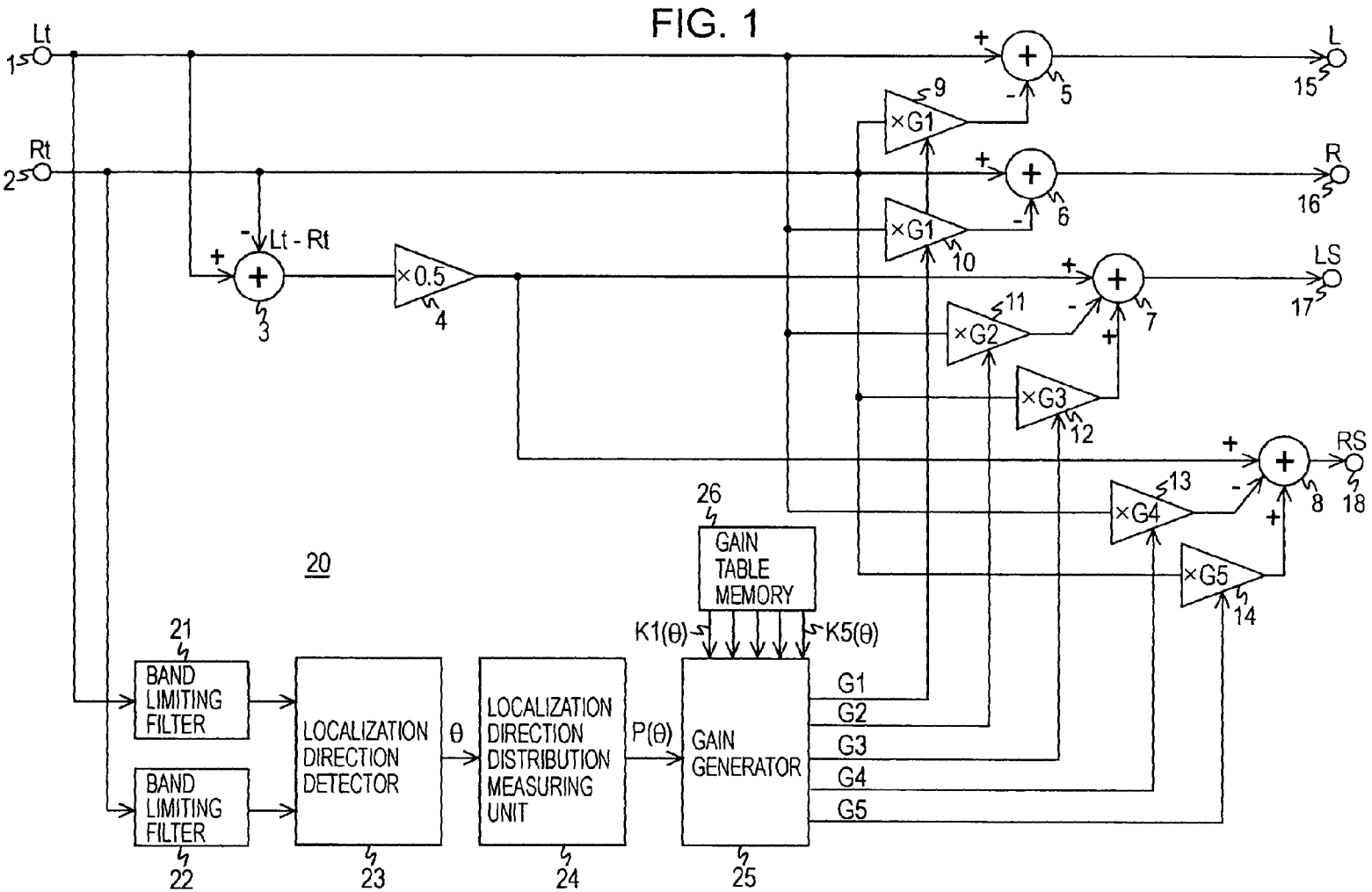
FIG. 1 is a block diagram illustrating an audio signal processing apparatus according to an embodiment of the present invention.

FIG. 1 is a block diagram illustrating an audio signal processing apparatus according to an embodiment of the present invention. In this embodiment, four-channel output audio signals, that is, a left channel output audio signal L, a right channel output audio signal R, a surround left-rear-channel output audio signal LS, and a surround right-rear-channel output audio signal RS are derived from two-channel input audio signals, that is, a left channel input audio signal Lt and a right channel input audio signal Rt.

The surround left-rear-channel output audio signal LS and the surround right-rear-channel output audio signal RS are to be supplied to a left rear speaker and a right rear speaker, respectively, for reproduction of surround sound.

As illustrated in FIG. 1, in this embodiment, there are provided four synthesizing circuits 5, 6, 7, and 8 for obtaining the left channel output audio signal L, right channel output audio signal R, surround left-rear-channel output audio signal LS, and surround right-rear-channel output audio signal RS, respectively. An output terminal 15 for the left channel output audio signal L, an output terminal 16 for the right channel output audio signal R, an output terminal 17 for the surround left-rear-channel output audio signal LS, and an output terminal 18 for the surround right-rear-channel output audio signal RS are derived from the synthesizing circuits 5, 6, 7, and 8, respectively.

The left channel input audio signal Lt from an input terminal 1 is supplied through a gain adjusting amplifier 10 to the synthesizing circuit 6 while being directly supplied to the synthesizing circuit 5 without passing through any gain adjusting amplifier.

Also, the right channel input audio signal Rt from an input terminal 2 is supplied through a gain adjusting amplifier 9 to the synthesizing circuit 5 while being directly supplied to the synthesizing circuit 6 without passing through any gain adjusting amplifier.

At the same time, the left channel input audio signal Lt and the right channel input audio signal Rt from the input terminal 1 and the input terminal 2, respectively, are supplied to a synthesizing circuit 3, from which a differential audio signal (Lt−Rt) obtained by subtracting the right channel input audio signal Rt from the left channel input audio signal Lt is output as a surround signal component.

This differential audio signal (Lt−Rt) from the synthesizing circuit 3 is gain-adjusted by a gain adjusting amplifier 4 to one-half and is directly supplied to the synthesizing circuits 7 and 8 without passing through any gain adjusting amplifier.

Additionally, the left channel input audio signal Lt is supplied through a gain adjusting amplifier 11 to the synthesizing circuit 7 and is also supplied through a gain adjusting amplifier 13 to the synthesizing circuit 8. At the same time, the right channel input audio signal Rt is supplied through a gain adjusting amplifier 12 to the synthesizing circuit 7 and is also supplied through a gain adjusting amplifier 14 to the synthesizing circuit 8.

The synthesizing circuit 5 enhances directivity by subtracting the right channel input audio signal Rt gain-adjusted by the gain adjusting amplifier 9 (in a manner described below) from the left channel input audio signal Lt. At the same time, the synthesizing circuit 5 generates the left channel output audio signal L controlled such that a natural sound can be achieved when separated from a surround sound. Then, the generated left channel output audio signal L is output to the output terminal 15.

The synthesizing circuit 6 enhances directivity by subtracting the left channel input audio signal Lt gain-adjusted by the gain adjusting amplifier 10 (in a manner described below) from the right channel input audio signal Rt. At the same time, the synthesizing circuit 6 generates the right channel output audio signal R controlled such that a natural sound can be achieved when separated from a surround sound. Then, the generated right channel output audio signal R is output to the output terminal 16.

The synthesizing circuit 7 subtracts the left channel input audio signal Lt gain-adjusted by the gain adjusting amplifier 11 from a difference between the input audio signals (Lt−Rt), and adds the right channel input audio signal Rt gain-adjusted by the gain adjusting amplifier 12 to the resulting signal (or subtracts the gain-adjusted right channel input audio signal Rt from the right-channel input audio signal Rt). This signal synthesis performed by the synthesizing circuit 7 enhances directivity and generates the surround left-rear-channel output audio signal LS controlled such that a natural sound can be achieved when separated from left and right channel sounds. Then, the generated output audio signal LS is output to the output terminal 17. The left channel input audio signal Lt gain-adjusted by the gain adjusting amplifier 11 and the right channel input audio signal Rt gain-adjusted by the gain adjusting amplifier 12 will be further described below.

The synthesizing circuit 8 subtracts the left channel input audio signal Lt gain-adjusted by the gain adjusting amplifier 13 from a difference between the input audio signals (Lt−Rt), and adds the right channel input audio signal Rt gain-adjusted by the gain adjusting amplifier 14 to the resulting signal (or subtracts the gain-adjusted right channel input audio signal Rt from the right-channel input audio signal Rt). This signal synthesis performed by the synthesizing circuit 8 enhances directivity and generates the surround right-rear-channel output audio signal RS controlled such that a natural sound can be achieved when separated from left and right channel sounds. Then, the generated surround right-rear-channel output audio signal RS is output to the output terminal 18. The left channel input audio signal Lt gain-adjusted by the gain adjusting amplifier 13 and the right channel input audio signal Rt gain-adjusted by the gain adjusting amplifier 14 will be further described below.

Gain adjustment values for the gain adjusting amplifiers 9 through 14 are generated by a gain adjustment value generating circuit 20 from the two-channel input audio signals Lt and Rt in a manner described below.

The gain adjustment value generating circuit 20 includes a band limiting filter 21, a band limiting filter 22, a localization direction detector 23, a localization direction distribution measuring unit 24, a gain generator 25, and a gain table memory 26.

The band limiting filters 21 and 22 eliminate frequency components (e.g., low-frequency components) that do not clearly exhibit localization direction characteristics from the two-channel input audio signals Lt and Rt input to the gain adjustment value generating circuit 20.

Then, the two-channel input audio signals Lt and Rt band-limited by the band limiting filters 21 and 22, respectively, are supplied to the localization direction detector 23. According to the levels of the respective band-limited input audio signals Lt and Rt, the localization direction detector 23 detects the localization direction of the two-channel input audio signals Lt and Rt at predetermined intervals.

In other words, the localization direction detector 23 samples the levels (or amplitudes) of the respective band-limited two-channel input audio signals Lt and Rt at predetermined sampling intervals. In this example, a localization direction at the latest sampling time is detected as a localization direction at the present time. Then, the localization direction detector 23 detects the localization direction of the two-channel input audio signals Lt and Rt at the latest sampling time using the levels of the respective input audio signals Lt and Rt at the latest sampling time and the levels of the respective input audio signals Lt and Rt at a sampling time before the latest sampling time.

If the two-channel input audio signals Lt and Rt are digital audio signals, sampling intervals at which the two-channel input audio signals Lt and Rt are sampled can be made equal to those of digital audio signals. The length of each sampling interval may not necessarily be equal to the length of a single sampling interval of digital audio signals, but may be equal to the length of a plurality of sampling intervals of digital audio signals. If input audio signals input to the localization direction detector 23 are analog signals, the input audio signals may be converted to digital audio signals at an input stage of the localization direction detector 23.

Figure 2A:
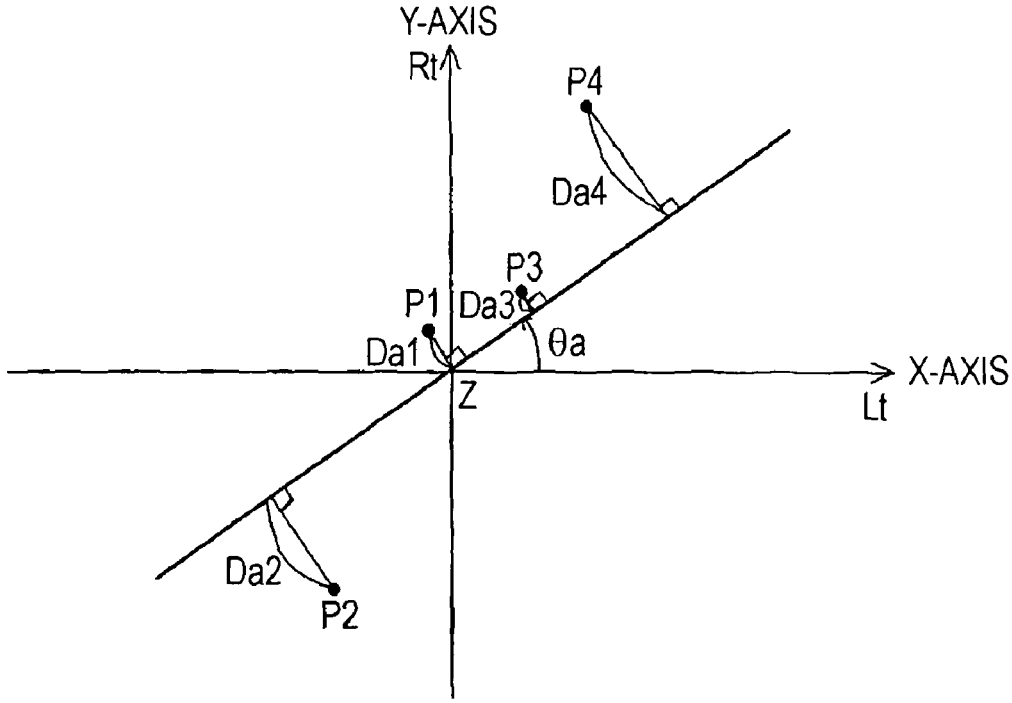
FIG. 2A and FIG. 2B are graphs for explaining a localization direction detecting operation performed by a localization direction detector of FIG. 1.
Figure 2B:
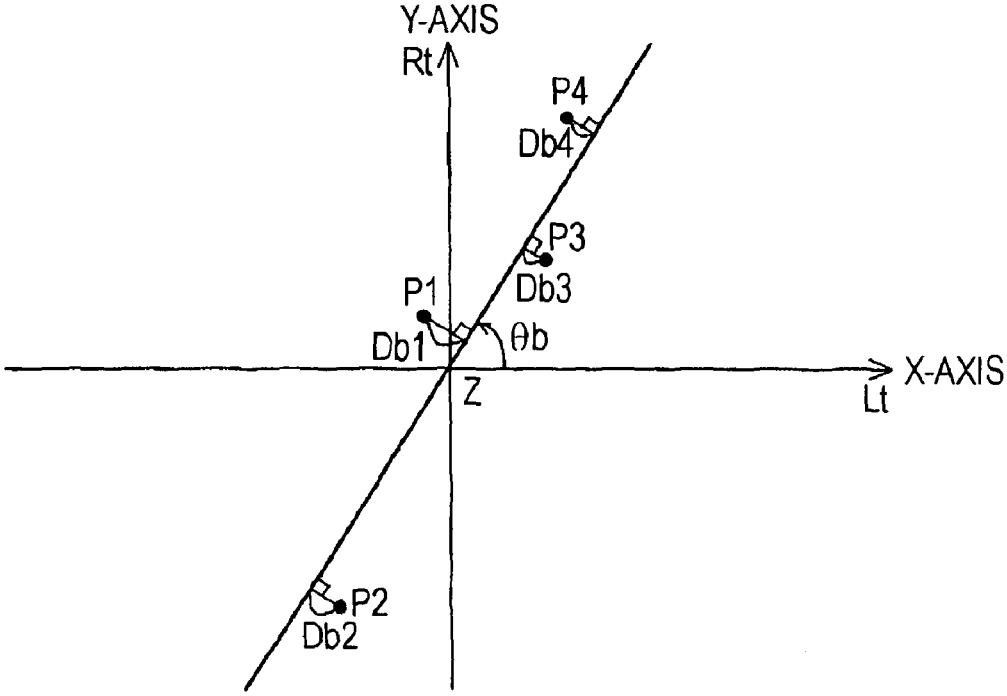

A method by which the localization direction detector 23 detects a localization direction will now be described with reference to FIG. 2A and FIG. 2B. Each of FIGS. 2A and 2B is a coordinate space in which the X-axis represents the amplitude of the left channel input audio signal Lt and the Y-axis represents the amplitude of the right channel input audio signal Rt.

The localization direction detector 23 first obtains the levels of the respective two-channel input audio signals Lt and Rt at predetermined sampling intervals, at each of which a localization direction is to be detected. Then, the localization direction detector 23 plots coordinate points, such as P1, P2, P3, and P4, corresponding to the respective obtained levels in the coordinate space of FIGS. 2A and 2B. In this example, P4 is a coordinate point corresponding to the latest detection time.

Then, the localization direction detector 23 calculates, when a straight line (which passes through an intersection point Z of the X-axis and Y-axis) represented by the equation $Y=k\cdot x$ (where k is a constant) is rotated by ±90 degrees about the intersection point Z (or the constant k is varied), the constant k (or slope angle) of a straight line that is closest to the plotted coordinate points P1, P2, P3, and P4. In other words, the localization direction detector 23 calculates the constant k of a straight line when the sum of distances Da1, Da2, Da3, and Da4 from the respective coordinate points P1, P2, P3, and P4 to the straight line (see FIG. 2A) or the sum of distances Db1, Db2, Db3, and Db4 from the respective coordinate points P1, P2, P3, and P4 to the straight line (see FIG. 2B) is minimized.

Then, the localization direction detector 23 determines a slope angle corresponding to the calculated constant k to be a localization direction at the present time. In the examples of FIGS. 2A and 2B, an angle θ from the X-axis (hereinafter referred to as "localization angle") is detected as a localization direction, where the angle of the X-axis or localization direction corresponding to the left channel (or left direction) is 0 degrees.

In the example of the coordinate points P1, P2, P3, and P4 of FIG. 2A, θa is detected as a localization angle. In the example of the coordinate points P1, P2, P3, and P4 of FIG. 2B, θb is detected as a localization angle.

In this embodiment, in the localization direction detector 23, a weight assigned to the levels of the two-channel input audio signals at the present time (or latest sampling time) is not the same as that assigned to the levels of the two-channel input audio signals at a past sampling time. A weight assigned to the levels of the two-channel input audio signals increases as the sampling time approaches the present time.

Figure 3:
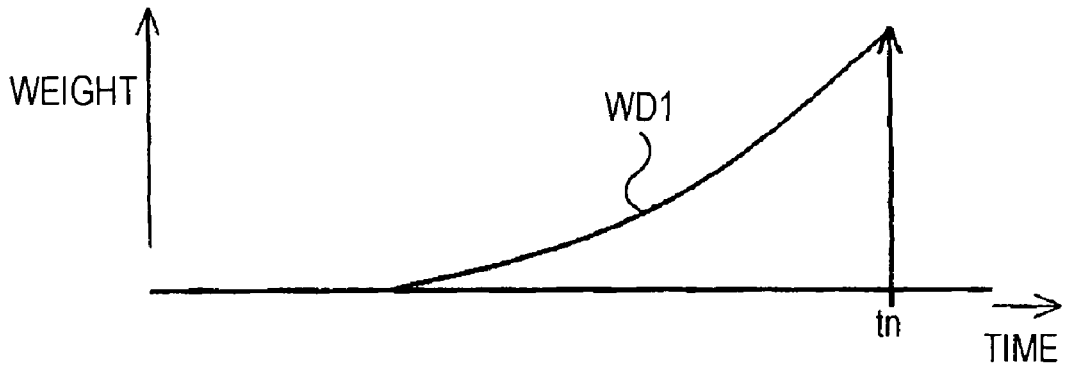
FIG. 3 is another graph for explaining the localization direction detecting operation performed by the localization direction detector of FIG. 1.

Therefore, as shown in FIG. 3, the localization direction detector 23 uses a time window WD1 having the characteristics of an exponential curve so that a weight assigned to the sampled levels of the respective two-channel input audio signals increases toward the present time (or the latest sampling time tn in this example).

In the foregoing description, the latest sampling time is regarded as the present time or processing time point.

However, the present time or processing time point may be a time that is delayed by τ from the input audio signals Lt and Rt input through the input terminals 1 and 2. This can be realized by providing, between the input terminals 1 and 2 and the synthesizing circuits 5 and 6, the input terminals 1 and 2 and the gain adjusting amplifiers 9 to 14, the gain adjusting amplifier 4 and the synthesizing circuits 7 and 8, or the like, a delay circuit which allows a delay of a predetermined time period τ.

In this case, the localization direction detector 23 can also use two-channel input audio signals at a time after (or later than) the present time to detect a localization direction. For example, in FIGS. 2A and 2B, P2 or P3 is the present time or processing time point.

In this case, instead of the time window WD1 described above, a time window WD2 (see FIG. 4) having the characteristics of an exponential curve in which a weight is maximized at the present time tp or processing time point and decreases with increasing time from the present time to both the past and future.

The levels of the two-channel input audio signals at the present time may be used without assigning any weight to the levels of the two-channel input audio signals at past and/or future sampling times.

Thus, the localization direction detector 23 can detect a localization angle θ as a localization direction of the two-channel input audio signals at the present time.

Therefore, by gain-controlling each of the gain adjusting amplifiers 9 to 14 according to the detected localization angle θ at the present time, it is possible to control the directivity and the degree of separation among the output audio signals L, R, LS, and RS. However, the detected localization angle θ at the present time only represents a single localization direction of input audio signals at a single time point and does not reflect a signal strength in each direction. Therefore, it is possible that high-quality output audio signals L, R, LS, and RS cannot be obtained.

In view of this aspect, in the present embodiment, a localization angle θ detected by the localization direction detector 23 as a localization direction of the two-channel input audio signals at the present time is supplied to the localization direction distribution measuring unit 24.

In this example, the localization direction distribution measuring unit 24 determines, for all directions, the distribution of localization angles θ detected by the localization direction detector 23 over a predetermined time period d. From the resulting distribution, the localization direction distribution measuring unit 24 measures what proportion of localization directions of two-channel input audio signals are present in which angular directions.

Figure 5:
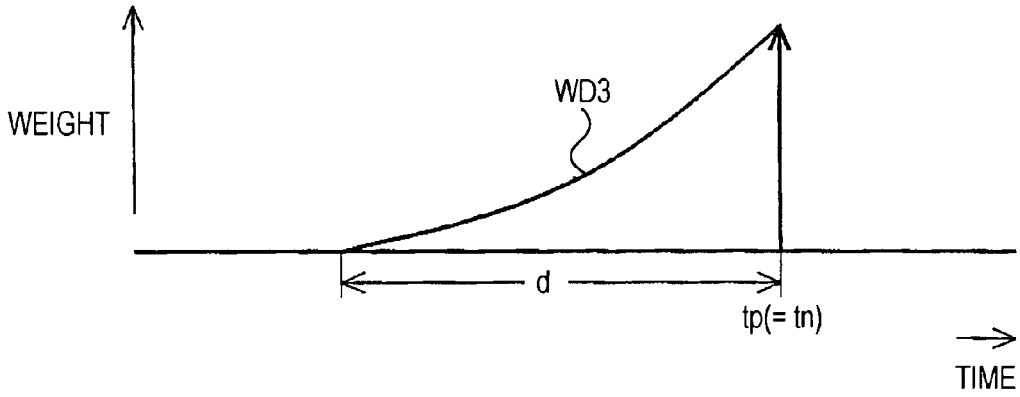
FIG. 5 is a graph used to describe a localization direction distribution measuring unit of FIG. 1.

In this case, the predetermined time period d ranges, for example, from several milliseconds to several hundreds of milliseconds. In this example, the predetermined time period d is set at several tens of milliseconds. In the present embodiment, the localization direction distribution measuring unit 24 applies a time window WD3 (see FIG. 5) to the localization angles θ detected by the localization direction detector 23 over the predetermined time period d. The time window WD3 has characteristics similar to those of the weighting factor used by the localization direction detector 23. That is, the localization direction distribution measuring unit 24 uses the time window WD3 to assign a weight that exponentially increases toward the present time tp (tp=tn (latest sampling time) in this example) to the localization angles θ detected by the localization direction detector 23.

Figure 4:
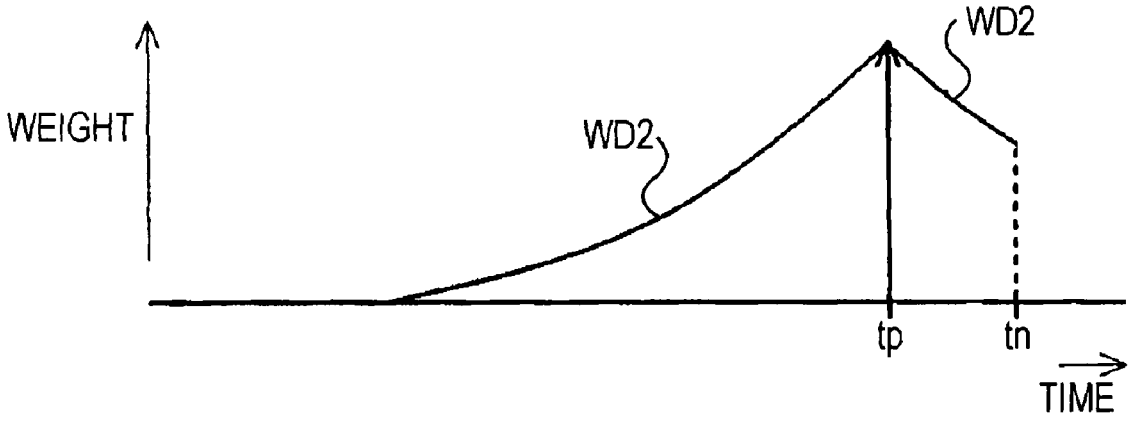
FIG. 4 is another graph for explaining the localization direction detecting operation performed by the localization direction detector of FIG. 1.

If, as described above, a delay time τ is added to input audio signals and the localization direction detector 23 uses the time window of FIG. 4 to perform weighting, the localization direction distribution measuring unit 24 uses a time window similar to that of FIG. 4. In this case, the predetermined time period d includes time periods both before and after the present time tp. Alternatively, the localization direction distribution measuring unit 24 may use the localization angles θ detected by the localization direction detector 23 without assigning any weight thereto.

Figure 6:
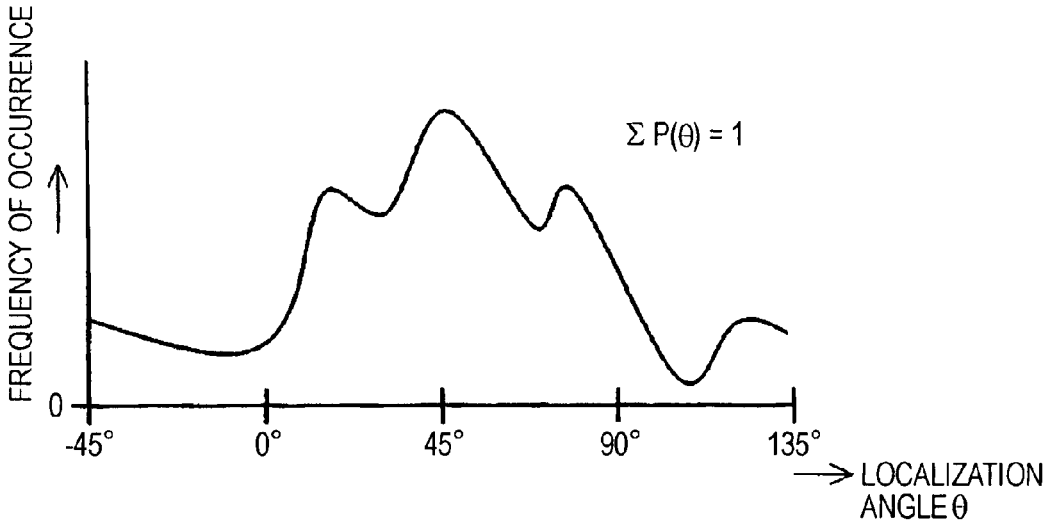
FIG. 6 is a graph used to describe an example of information output from the localization direction distribution measuring unit of FIG. 1.

FIG. 6 shows an exemplary localization direction distribution P(θ) that is a distribution of localization angles θ, the distribution being determined by the localization direction distribution measuring unit 24. The horizontal axis represents the localization angle θ with respect to the X-axis (or localization direction for the left channel), while the vertical axis represents the frequency of occurrence (<1) of each localization angle. In the present embodiment, a distribution is generated such that the sum of the localization direction distributions P(θ) determined for all localization angles θ is equal to 1, that is, the equation $\Sigma P(\theta)=1$ is satisfied.

Figure 7:
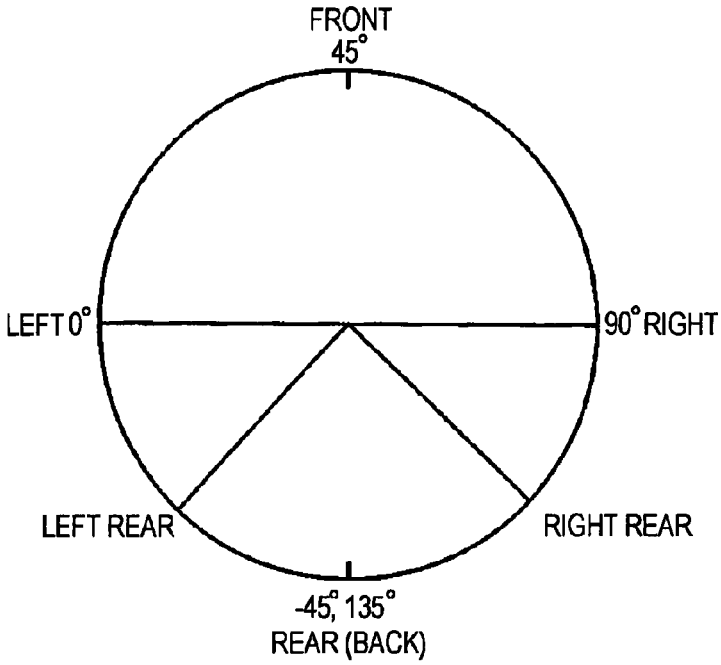
FIG. 7 is a diagram used to describe an example of information output from the localization direction distribution measuring unit of FIG. 1.

FIG. 7 illustrates the relationship between a localization angle θ and a localization direction of an audio signal. The "front" direction, "left" direction, "right" direction, and the like shown in FIG. 7 are direction from the listener.

Thus, information about the localization direction distribution P(θ) as shown in FIG. 6 can be obtained from the localization direction distribution measuring unit 24 at each present time (or the present sampling time or processing time point). Information about the localization direction distribution P(θ) is supplied to the gain generator 25, which generates, in a manner described below, gain control signals G1 to G5 which are to be supplied to the gain adjusting amplifiers 9 to 14.

In the present embodiment, the gain table memory 26 is connected to the gain generator 25. The gain table memory 26 prestores gain table information K1(θ) to K5(θ) corresponding to the six gain adjusting amplifiers 9 to 14.

Each of the gain table information K1(θ) to K5(θ) shows gain characteristics in which gains for all localization angles (ranging from −45 to 135 degrees) are weighted according to the localization direction required for each output audio signal.

In this example, the gain table information K1(θ) corresponds to the gain adjusting amplifiers 9 and 10, the gain table information K2(θ) corresponds to the gain adjusting amplifier 11, the gain table information K3(θ) corresponds to the gain adjusting amplifier 12, the gain table information K4(θ) corresponds to the gain adjusting amplifier 13, and the gain table information K5(θ) corresponds to the gain adjusting amplifier 14. In each gain table information, weighting is performed such that a gain for a direction in which an output audio signal of the corresponding output channel is to be localized is enhanced. Examples of the gain table information K1(θ) to K5(θ) are shown in FIG. 8 to FIG. 12, respectively.

For example, the synthesizing circuit 5 subtracts the right-channel input audio signal Rt gain-adjusted by the gain adjusting amplifier 9 from the left-channel input audio signal Lt, while the synthesizing circuit 6 subtracts the left-channel input audio signal Lt gain-adjusted by the gain adjusting amplifier 10 from the right-channel input audio signal Rt. Thus, the left channel output audio signal L and right channel output audio signal R separated from rear surround sound components are derived from the synthesizing circuits 5 and 6, respectively.

Figure 8:
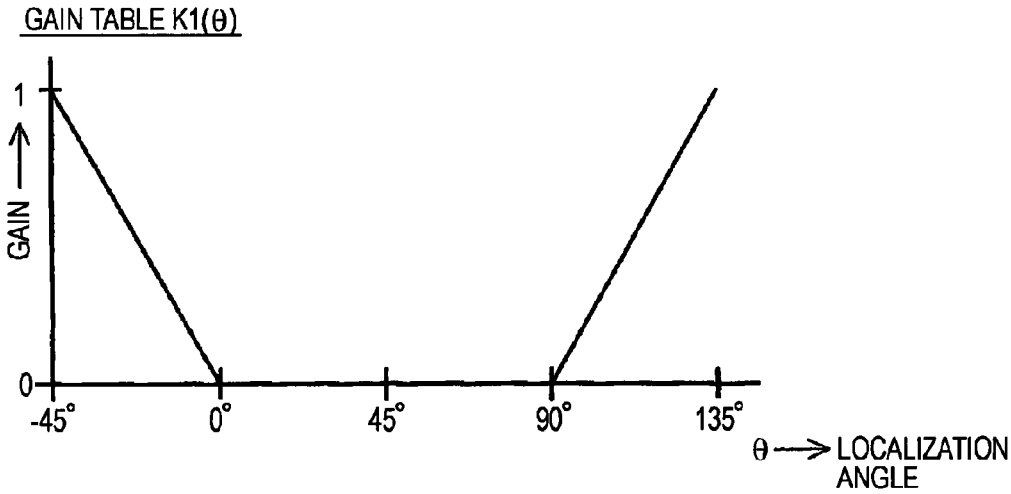
FIG. 8 shows an exemplary gain table used in the embodiment of FIG. 1.

Therefore, as shown in FIG. 8, in the gain table information K1(θ) corresponding to the gain adjusting amplifiers 9 and 10, a gain for localization angles (0 to 90 degrees) corresponding to directions from the left through the center to the right is set to zero. For localization angles (0 to −45 degrees) corresponding to directions from the left to the back and localization angles (90 to 135 degrees) corresponding to directions from the right to the back, a gain increases toward the back.

Since, in this particular case, the gain adjusting amplifiers 9 and 10 happen to have the same gain characteristics, one and the same gain table information K1(θ) is supplied to both the gain adjusting amplifiers 9 and 10. However, in principle, gain table information is prepared for each of the gain adjusting amplifiers 9 and 10.

The synthesizing circuit 7 subtracts the left channel input audio signal Lt gain-adjusted by the gain adjusting amplifier 11 from a difference between the left and right two input audio signals (Lt−Rt), and adds thereto the right channel input audio signal Rt gain-adjusted by the gain adjusting amplifier 12. Thus, of the rear surround sound components, the surround left-rear-channel output audio signal LS (or a left rear component) is separated and output from the synthesizing circuit 7.

Figure 9:
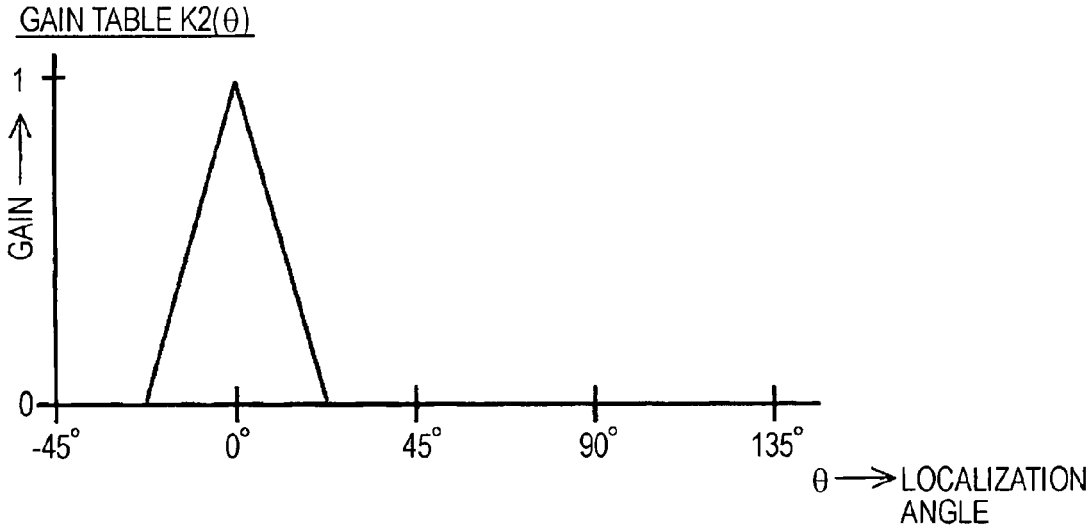
FIG. 9 shows another exemplary gain table used in the embodiment of FIG. 1.

Therefore, as shown in FIG. 9, in the gain table information K2(θ) corresponding to the gain adjusting amplifier 11, a gain is maximized at a localization angle (0 degrees) corresponding to the left direction. For localization angles (0±22.5 degrees in FIG. 9) around the localization angle corresponding to the left direction, a gain gradually decreases to zero with increasing deviation from the localization angle corresponding to the left direction. For the other localization angles, a gain is set to zero.

Figure 10:
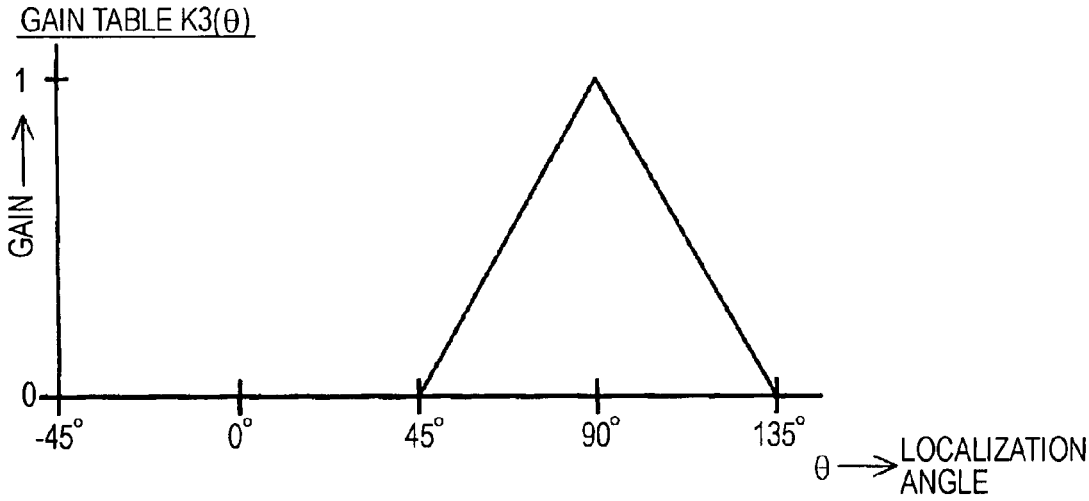
FIG. 10 shows another exemplary gain table used in the embodiment of FIG. 1.

At the same time, as shown in FIG. 10, in the gain table information K3(θ) corresponding to the gain adjusting amplifier 12, a gain is maximized at a localization angle (90 degrees) corresponding to the right direction. For localization angles (90±22.5 degrees in FIG. 10) around the localization angle corresponding to the right direction, a gain gradually decreases to zero with increasing deviation from the localization angle corresponding to the right direction. For the other localization angles, a gain is set to zero.

As shown in FIG. 9, the gain adjusting amplifier 11 has gain characteristics represented by a curve that is steep in the angular range around the localization angle corresponding to the left direction, while as shown in FIG. 10, the gain adjusting amplifier 12 has gain characteristics represented by a curve that is less steep in the angular range around the localization angle corresponding to the right direction. Therefore, a left rear component is separated and output from the synthesizing circuit 7.

The synthesizing circuit 8 subtracts the left channel input audio signal Lt gain-adjusted by the gain adjusting amplifier 13 from a difference between the left and right two input audio signals (Lt−Rt), and adds thereto the right channel input audio signal Rt gain-adjusted by the gain adjusting amplifier 14. Thus, of the rear surround sound components, the surround right-rear-channel output audio signal RS (or a right rear component) is separated and output from the synthesizing circuit 8.

Figure 11:
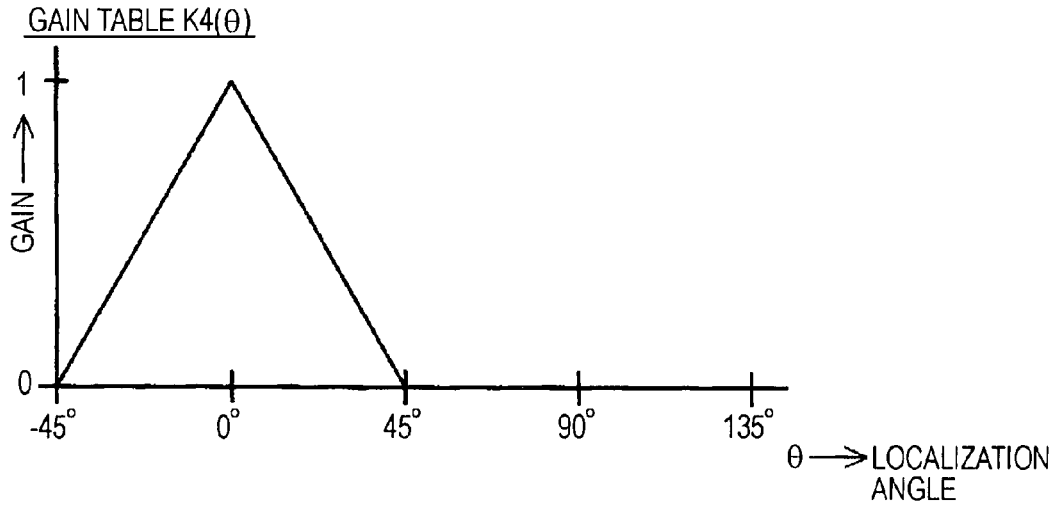
FIG. 11 shows another exemplary gain table used in the embodiment of FIG. 1.

Therefore, as shown in FIG. 11, in the gain table information K4(θ) corresponding to the gain adjusting amplifier 13, a gain is maximized at a localization angle (0 degrees) corresponding to the left direction. For localization angles (0±45 degrees in FIG. 11) around the localization angle corresponding to the left direction, a gain gradually decreases to zero with increasing deviation from the localization angle corresponding to the left direction. For the other localization angles, a gain is set to zero.

Figure 12:
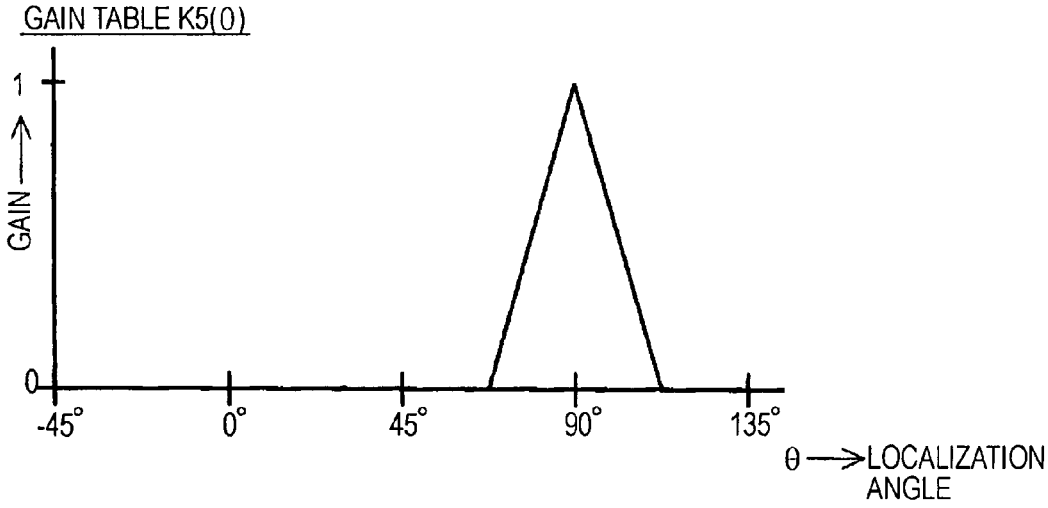
FIG. 12 shows another exemplary gain table used in the embodiment of FIG. 1.

At the same time, as shown in FIG. 12, in the gain table information K5(θ) corresponding to the gain adjusting amplifier 14, a gain is maximized at a localization angle (90 degrees) corresponding to the right direction. For localization angles (90±22.5 degrees in FIG. 12) around the localization angle corresponding to the right direction, a gain gradually decreases to zero with increasing deviation from the localization angle corresponding to the right direction. For the other localization angles, a gain is set to zero.

As shown in FIG. 11, the gain adjusting amplifier 13 has gain characteristics represented by a curve that is less steep in the angular range around the localization angle corresponding to the left direction, while as shown in FIG. 12, the gain adjusting amplifier 14 has gain characteristics represented by a curve that is steep in the angular range around the localization angle corresponding to the right direction. Therefore, a right rear component is separated and output from the synthesizing circuit 8.

The above-described five pieces of gain table information K1(θ) to K5(θ) recorded in the gain table memory 26 are supplied to the gain generator 25. For each of the five pieces of gain table information K1(θ) to K5(θ), the gain generator 25 calculates the sum of products, each product being obtained by multiplying, for every localization direction, the corresponding gain value in the gain table information with a value of the localization direction distribution P(θ) determined by the localization direction distribution measuring unit 24.

In other words, the gain generator 25 generates gain control signals G1 to G5 according to the following equations:

$$G1=\Sigma(K1(\theta)\times P(\theta))$$

$$G2=\Sigma(K2(\theta)\times P(\theta))$$

$$G3=\Sigma(K3(\theta)\times P(\theta))$$

$$G4=\Sigma(K4(\theta)\times P(\theta))$$

$$G5=\Sigma(K5(\theta)\times P(\theta))$$

Then, the gain control signal G1 is supplied to the gain adjusting amplifiers 9 and 10, the gain control signal G2 is supplied to the gain adjusting amplifier 11, the gain control signal G3 is supplied to the gain adjusting amplifier 12, the gain adjusting amplifier 4 is supplied to the gain adjusting amplifier 13, and the gain control signal G5 is supplied to the gain adjusting amplifier 14. Thus, the gain adjusting amplifiers 9 to 14 are gain-adjusted.

The gain control described above makes it possible to suppress crosstalk components according to the distribution of localization directions of actual left and right two-channel input audio signals. Four-channel output audio signals that are naturally separated and have natural directivity can thus be derived from the synthesizing circuits 5 to 8.

In the present embodiment, instead of enhancing or controlling only a specific localization direction, the distribution of localization directions corresponding to all localization angles is reflected in the generation of audio signals in output channels. Therefore, it is possible to obtain multichannel signals with natural continuity without having to perform particularly complex control.

Although four output channels are generated in the embodiment described above, the number of output channels to be generated is not limited to this. That is, the number of output channels to be generated may be any number greater than or equal to three.

The localization directions of the output channel signals described above are merely examples and are not intended to be limiting. For example, the above-described four output channel signals, that is, the left channel output audio signal L, right channel output audio signal R, surround left-rear-channel output audio signal LS, and surround right-rear-channel output audio signal RS may be changed to a left channel output audio signal L, center channel output audio signal C, right channel output audio signal R, and surround channel output audio signal S. It will be understood that output channel signals may be directed to other directions.

Additionally, although gain characteristic curves shown in the gain table information of FIGS. 8 to 12 are linear, they may be non-linear curves representing other gain characteristics.

Moreover, although two-channel input signals in the embodiment described above are left and right channel stereo signals, the localization directions of the two-channel input signals are not limited to the left and right directions.

In the embodiment described above, some input audio signals Lt and Rt and/or synthesized signals (Lt−Rt) gain-adjusted to one-half are supplied to their corresponding synthesizing circuits without passing through any gain adjusting amplifier. However, all input audio signals Lt and Rt and/or synthesized signals (Lt−Rt) gain-adjusted to one-half may be supplied to their corresponding synthesizing circuits through appropriate gain adjusting amplifiers.

Other Embodiments

Instead of being provided as a single unit, the audio signal processing apparatus of FIG. 1 may be divided into one part for deriving output audio signals L and R and the other part for deriving output audio signals LS and RS. In other words, the audio signal processing apparatus of the above-described embodiment may be divided into two parts, one part for deriving two-channel output audio signals having the same channel directions as those of two-channel input audio signals and enhanced in directivity, and the other part for synthesizing two-channel input audio signals to derive output channel signals having directivity different from that of input audio signals.

That is, the audio signal processing apparatus of FIG. 1 may be divided into a first part and a second part, the first part including the synthesizing circuits 5 and 6, gain adjusting amplifiers 9 and 10, and gain adjustment value generating circuit 20, and the second part including the synthesizing circuits 7 and 8, gain adjusting amplifiers 11, 12, 13, and 14, and a gain adjustment value generating circuit.

In such a case, each of the first and second parts alone can serve as an independent audio signal processing apparatus. For example, the first part may be used to detect rear-localized sound components in the left and right two-channel input audio signals, attenuate the detected sound components, and thereby improve separation between the left and right channels.

Although the audio signal processing apparatus of FIG. 1 is configured such that one of the left and right two-channel audio signals is synthesized with the other channel audio signal that is gain-adjusted, the configuration of the first part described above is not limited to this. For example, the left and right channel audio signals may be synthesized with a signal obtained by gain-adjusting a signal generated by synthesizing these left and right channel audio signals.

The second part may be used to separate and obtain, from two-channel input audio signals, a single-channel audio signal such as a surround channel output audio signal S or a center channel output audio signal C, or two-channel output audio signals such as a surround left-rear-channel output audio signal LS and a surround right-rear-channel output audio signal RS. The second part may also be used to synthesize left and right channel audio signals to derive a center channel audio signal.

The audio signal processing apparatus described above can be realized by software processing performed by a computer including a digital signal processor (DSP). In this case, each block configuration can be realized by a functional processor (or software) according to a program which causes the computer to operate.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing apparatus comprising:

a localization direction detector to detect localization directions of two-channel input audio signals;

a localization direction distribution calculator to calculate a distribution of the localization directions detected by the localization direction detector;

a gain table information recording unit to record gain table information defining weights corresponding to respective localization angles;

a gain generator to generate a gain corresponding to an output audio signal on the basis of the distribution calculated by the localization direction distribution calculator and the gain table information recorded in the gain table information recording unit; and a synthesizing unit to synthesize the two-channel input audio signals using the gain generated by the gain generator.

2. The audio signal processing apparatus according to claim 1, wherein the synthesizing unit adjusts one of the two-channel input audio signals with a gain generated by the gain generator and after adjusting synthesizes the one signal with the other of the two-channel input audio signals.

3. The audio signal processing apparatus according to claim 1, further comprising a differential signal generator that generates a differential signal between signals of the two-channel input audio signals, wherein the synthesizing unit adjusts at least one of the two-channel input audio signals with a gain generated by the gain generator and synthesizes the adjusted signal with the differential signal generated by the differential signal generator.

4. The audio signal processing apparatus according to claim 1, wherein the gain table information recording unit records at least two pieces of gain table information; and the gain generator that generates at least two gains on the basis of the distribution calculated by the localization direction distribution calculator and the at least two pieces of gain table information recorded by the gain table information recording unit.

5. The audio signal processing apparatus according to claim 4, further comprising a differential signal generator that generates a differential signal between signals of the two-channel input audio signals, wherein the synthesizing unit adjusts the two-channel input audio signals with the respective at least two gains generated by the gain generator and synthesizes the adjusted signals with the differential signal generated by the differential signal generator.

6. The audio signal processing apparatus according to claim 1, further comprising band limiting filters that band-limit the two-channel input audio signals by eliminating predetermined frequency components therefrom, wherein the two-channel input audio signals band-limited by the band limiting filters are supplied to the localization direction detector.

7. The audio signal processing apparatus according to claim 1, wherein the localization direction detector refers to past localization directions of the two-channel input audio signals, the past localization directions being detected before a predetermined time, to detect a localization direction of the two-channel input audio signals.

8. The audio signal processing apparatus according to claim 7, wherein the past localization directions are weighted according to their corresponding time differences from the predetermined time and are referred to by the localization direction detector.

9. The audio signal processing apparatus according to claim 8, wherein the past localization directions are weighted such that higher weights are assigned to past localization directions detected at times closer to the predetermined time.

10. The audio signal processing apparatus according to claim 1, wherein the localization direction detector refers to future localization directions of the two-channel input audio signals, the future localization directions being detected after a predetermined time, to detect a localization direction of the two-channel input audio signals.

11. An audio signal processing method comprising:

detecting localization directions of two-channel input audio signals;

calculating a distribution of the detected localization directions;

recording gain table information that defines weights corresponding to respective localization angles;

generating a gain corresponding to an output audio signal based at least in part on of the calculated distribution and the recorded gain table information; and synthesizing the two-channel input audio signals using the generated gain.

12. A tangible computer readable medium on which is stored a program that when implemented by a computer included in an audio signal processing apparatus causes the computer to execute a method comprising:

detecting localization directions of two-channel input audio signals;

calculating a distribution of the detected localization directions;

recording gain table information that defines weights corresponding to respective localization angles;

generating a gain corresponding to an output audio signal based at least in part on of the calculated distribution and the recorded gain table information; and synthesizing the two-channel input audio signals using the generated gain.

13. An audio signal processing apparatus comprising:

localization direction detecting unit that detects localization directions of two-channel input audio signals;

localization direction distribution calculating unit that calculates a distribution of the localization directions detected by the localization direction detecting unit;

gain table information recording unit that records gain table information that defines weights corresponding to respective localization angles;

gain generating unit that generates a gain corresponding to an output audio signal on the basis of the distribution calculated by the localization direction distribution calculating unit and the gain table information recorded in the gain table information recording unit; and synthesizing unit that synthesizes the two-channel input audio signals using the gain generated by the gain generating unit.

* * * * *